US005211338A

United States Patent [19]

Leite et al.

[11] Patent Number: 5,211,338

[45] Date of Patent: May 18, 1993

[54] SPRINKLER SHIELD

[76] Inventors: Diva C. Leite, 5274 E. Sunbuest Dr., Palmdale, Calif. 93550; Tony C. Leite, P.O. Box 902211, Palmdale, Calif. 93590

[21] Appl. No.: 807,592

[22] Filed: Dec. 16, 1991

[51] Int. Cl.[5] ..... B05B 15/06

[52] U.S. Cl. ..... 239/276; 239/288.5

[58] Field of Search ..... 239/276, 288, 288.3, 239/288.5

[56] References Cited

U.S. PATENT DOCUMENTS

| | | | |
|---|---|---|---|
| 1,674,693 | 6/1928 | Macgregor | 239/276 X |
| 2,751,250 | 6/1956 | Block | 239/276 X |
| 3,015,448 | 1/1962 | Hurless | 239/288.5 X |
| 3,485,449 | 12/1969 | Wilson | 239/288.3 X |
| 3,762,642 | 10/1973 | Di Santo | 339/288.5 X |
| 3,865,309 | 2/1975 | Greenhalgh | 239/276 X |
| 3,904,120 | 9/1975 | Sbicca | 239/288.5 X |
| 5,037,030 | 8/1991 | Apodaca | 239/288 |

*Primary Examiner*—Andres Kashnikow
*Assistant Examiner*—Kevin P. Weldon
*Attorney, Agent, or Firm*—Leon Gilden

[57] ABSTRACT

A sprinkler shield is arranged to receive a sprinkler head in a surrounding relationship to minimize vegetation growth thereabout. The shield is arranged with frangible portions to permit geometric tailoring of the shield relative to a sprinkler head environment. The shield structure further includes spike members mounted to a bottom surface of the shield for projection into an underlying ground surface.

2 Claims, 4 Drawing Sheets

SPRINKLER SHIELD

BACKGROUND OF THE INVENTION

1. Field of the Invention

The field of invention relates to sprinkler apparatus, and more particularly pertains to a new and improved sprinkler shield wherein the same is arranged to receive a sprinkler head therethrough to afford protection and minimize vegetation growth about the sprinkler head.

2. Description of the Prior Art

Sprinkler heads that project through a surrounding lawn are typically subject to blockage from vegetation growth and overgrowth relative to the sprinkler head. Various prior art structure has been implemented to minimize such growth and such is exemplified in U.S. Pat. No. 3,514,040 to Carson utilizing a sprinkler cage positioned about a sprinkler head to afford protection to the sprinkler head.

The U.S. Pat. No. 3,762,642 to Di Santo sets forth a grass guard for sprinkler heads to surroundingly protect a sprinkler head relative to vegetation growth utilizing various sections that are of a step fit or relatively securable relative to one another.

U.S. Pat. No. 3,801,014 to Cantales sets forth a sprinkler cover to provide cover for sprinkler heads utilizing symmetrical parts forming a hollow cavity therebetween to receive a fluid pipe and sprinkler head therebetween.

U.S. Pat. No. 4,146,181 to Soos sets forth a guard ring for surroundingly receiving a sprinkler head therethrough.

It may be appreciated therefore that there continues to be a need for a new and improved sprinkler shield as set forth by the instant invention which addresses both the problems of ease of use as well as effectiveness in construction in accommodating sprinkler heads mounted within a lawn environment within various geographical and geometric positions within that lawn environment and in this respect, the present invention substantially fulfills this need.

SUMMARY OF THE INVENTION

In view of the foregoing disadvantages inherent in the known types of sprinkler shield construction now present in the prior art, the present invention provides a sprinkler shield wherein the same is arranged to afford a cover for securement into an underlying surface surroundingly protecting a sprinkler head directed through the shield structure. As such, the general purpose of the present invention, which will be described subsequently in greater detail, is to provide a new and improved sprinkler shield which has all the advantages of the prior art sprinkler shield construction and none of the disadvantages.

To attain this, the present invention provides a sprinkler shield arranged to receive a sprinkler head in a surrounding relationship to minimize vegetation growth thereabout. The shield is arranged with frangible portions to permit geometric tailoring of the shield relative to a sprinkler head environment. The shield structure further includes spike members mounted to a bottom surface of the shield for projection into an underlying ground surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sprinkler shield which has all the advantages of the prior art sprinkler shield construction and none of the disadvantages.

It is another object of the present invention to provide a new and improved sprinkler shield which may be easily and efficiently manufactured and marketed.

It is a further object of the present invention to provide a new and improved sprinkler shield which is of a durable and reliable construction.

An even further object of the present invention is to provide a new and improved sprinkler shield which is susceptible of a low cost of manufacture with regard to both materials and labor, and which accordingly is then susceptible of low prices of sale to the consuming public, thereby making such sprinkler shields economically available to the buying public.

Still yet another object of the present invention is to provide a new and improved sprinkler shield which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
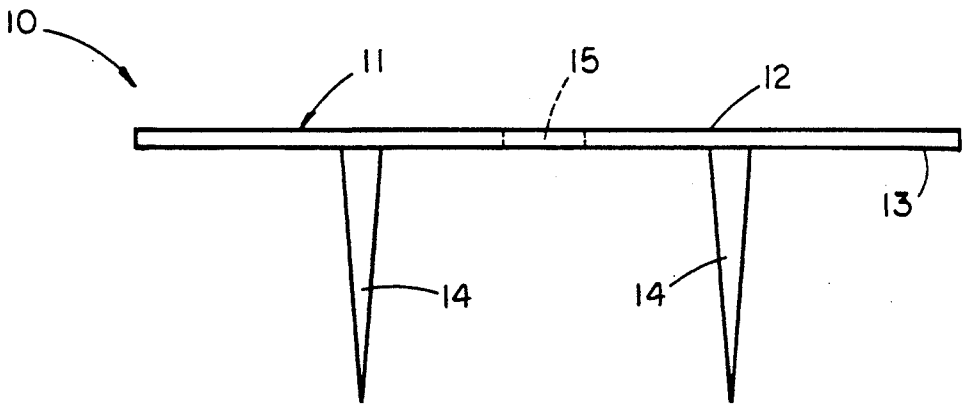
FIG. 1 is an orthographic side view of the instant invention.

With reference now to the drawings, and in particular to FIGS. 1 to 11 thereof, a new and improved sprinkler shield embodying the principles and concepts of the present invention and generally designated by the reference numeral 10 will be described.

Figure 2:
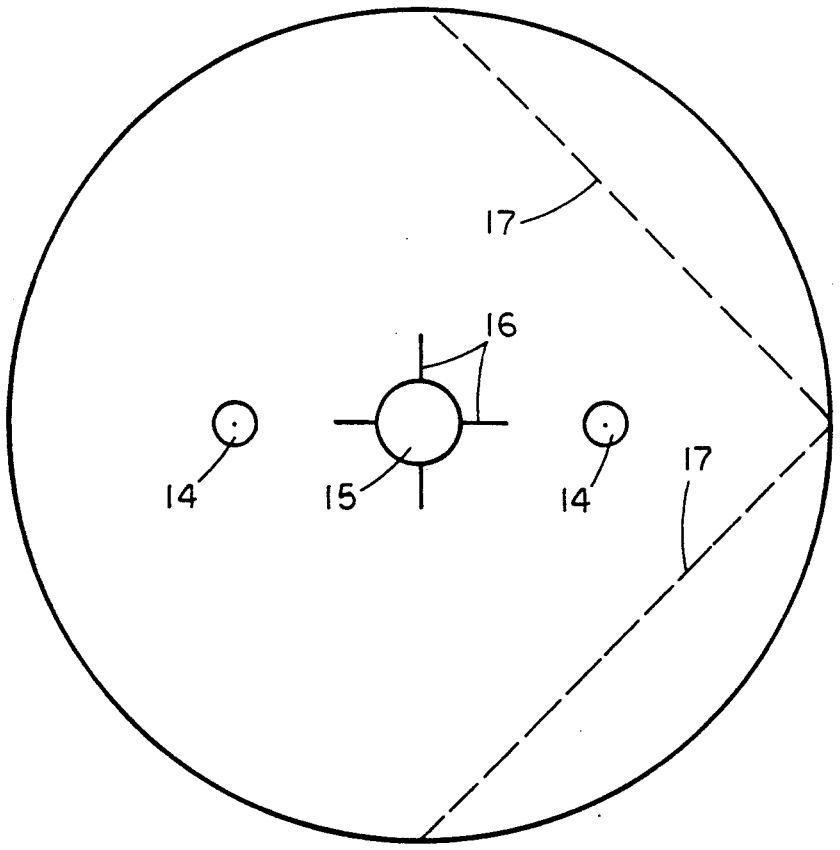
FIG. 2 is an orthographic bottom view of the instant invention.

More specifically, the sprinkler shield 10 of the instant invention essentially comprises a rigid cylindrical plate 11, including a planar top surface 12 spaced from and parallel a planar bottom surface 13. A plurality of rigid mounting spikes 14 extend orthogonally downwardly relative to the planar bottom surface 13 terminating at a lowermost pointed end. A central bore 15 is coaxially directed through the cylindrical plate 11 and includes a plurality of radial slots 16 extending from the central bore 15 as the slots 16 are spaced ninety degrees apart to effect flexure in the plate construction in accommodating a sprinkler head to be received therethrough. The FIG. 2 illustrates a plurality of frangible grooves 17 intersecting one another at ninety degrees at a perimeter of the plate 11 to permit removal of segments of the plate to provide for positioning of a sprinkler head relative to a corner portion of a lawn, such as in the FIG. 11 set forth as item 23.

Figure 3:
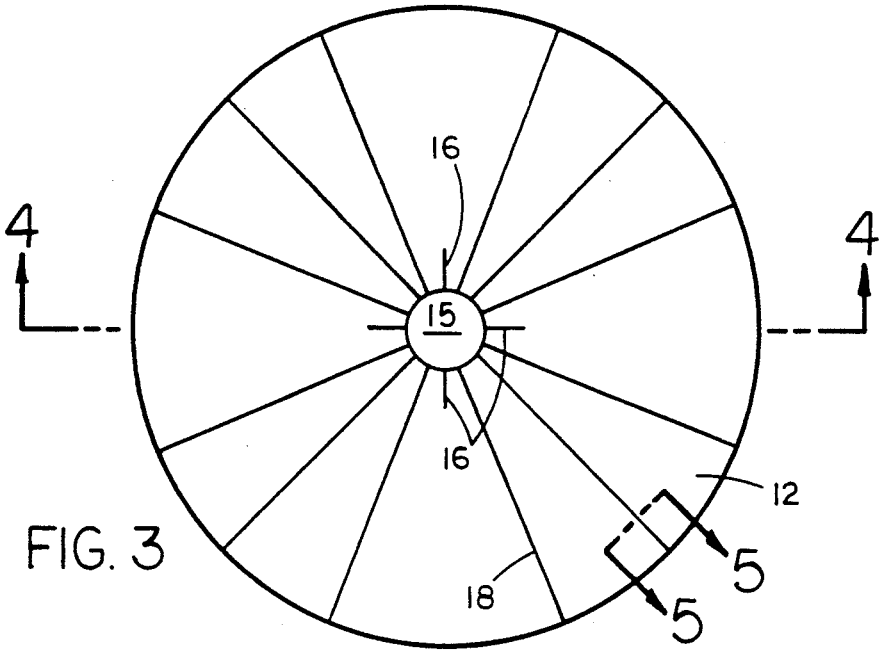
FIG. 3 is an orthographic top view of a modification of the invention.
Figure 4:
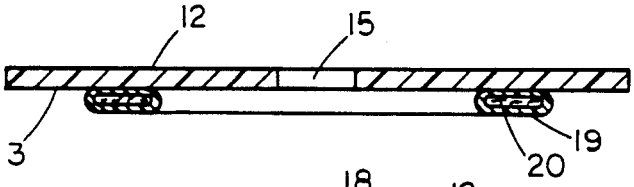
FIG. 4 is an orthographic view, taken along the lines 4—4 of FIG. 3 in the direction indicated by the arrows.
Figure 5:
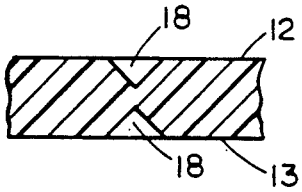
FIG. 5 is an orthographic view, taken along the lines 5—5 of FIG. 3 in the direction indicated by the arrows.
Figure 6:
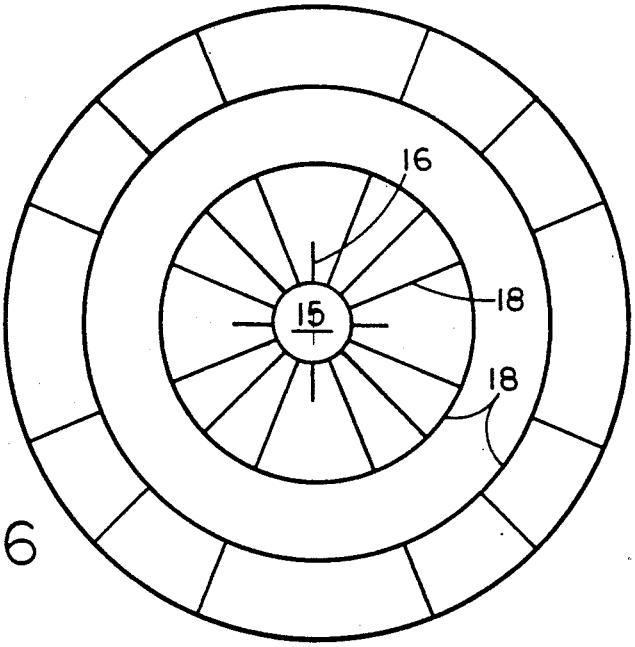
FIG. 6 is an orthographic top view of the shield structure utilizing a variously configured grooved surface construction to permit selective removal of portions of the FIG. 7 is an isometric illustration of a spike member utilized by the invention.
Figure 7:
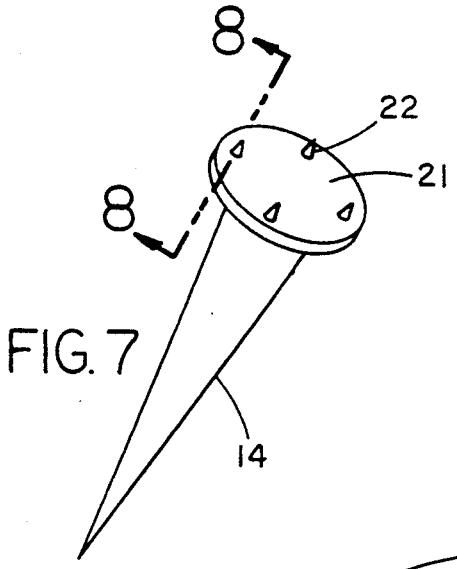
Figure 8:
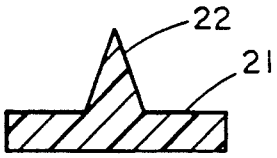
FIG. 8 is an orthographic view, taken along the lines 8—8 of FIG. 7 in the direction indicated by the arrows.
Figure 9:
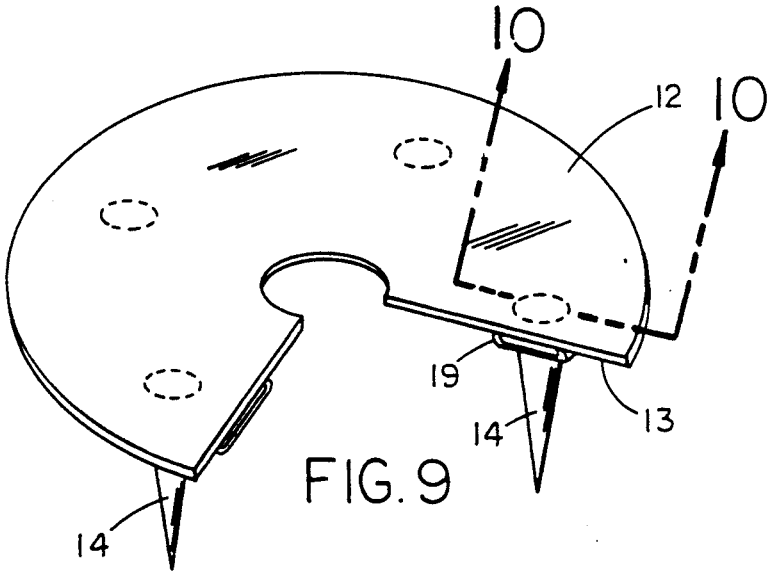
FIG. 9 is an isometric illustration of the shield construction utilizing the spike members as illustrated in FIG. 7.
Figure 10:
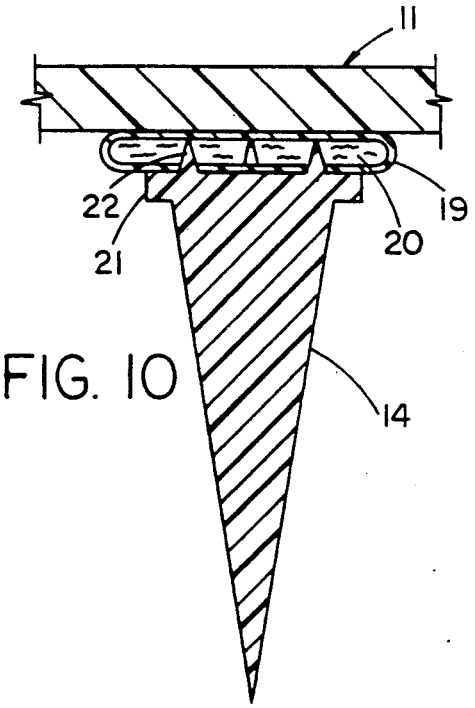
FIG. 10 is an orthographic view, taken along the lines 10—10 of FIG. 9 in the direction indicated by the arrows.
Figure 11:
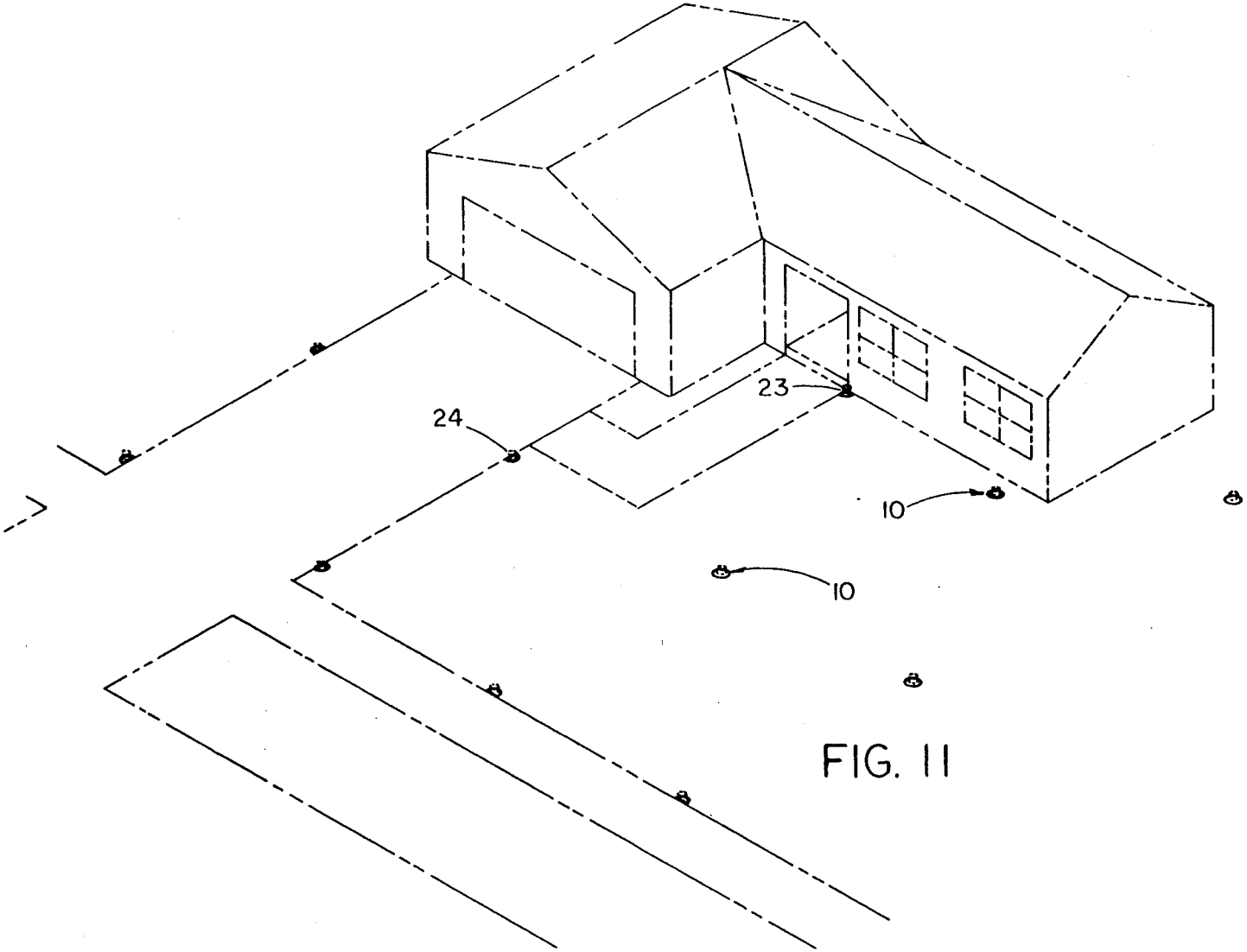
FIG. 11 is an isometric illustration of the invention arranged in various positions within a lawn environment.

The FIGS. 3 and 5 illustrate the pairs of coextensive and aligned grooves 18 that extend radially relative to the bore 15, with confronting grooves directed into the top surface and bottom surface defining a pair to permit ease of separation of various segments of the plate to provide for the custom fitting of the plate structure relative to the lawn, such as the use of a corner segment 23 or a semi-circular segment 24 as illustrated in the FIG. 11. The FIG. 6 illustrates a further configuration utilizing the radial grooves as well as a plurality of concentric grooves to permit the use of a smaller circular plate if required.

The FIGS. 4 and 7-10 illustrate the plate structure 11 including a torroidal tube 19 coaxially and fixedly mounted to the bottom surface 13, with the tube including a liquid adhesive 20 contained therewithin. A plurality of spike base plates 21 are provided, with each spike base plate 21 including a spike 14 projecting downwardly and orthogonally relative to each spike base plate in a coaxial relationship, with the spike base plate orthogonally oriented relative to the axis of the spike 14, with the spike base plate further including a plurality of base plate spikes 22 projecting upwardly relative to the spike base plate 21. The plurality of base plate spikes 22 are arranged for projection into the torroidal tube 19 permitting the liquid adhesive 20 to fixedly secure the spike base plate 21 in an adjustable relationship relative to the tube 19 and the plate 11 to permit adjustment of the spikes relative to the plate to permit positioning of the spikes in a most advantageous position relative to a lawn environment.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sprinkler shield, comprising, a cylindrical plate, the cylindrical plate including a central bore coaxially directed through the central plate, with the cylindrical plate including a top surface spaced from and parallel to a bottom surface, and a plurality of mounting spikes secured relative to the bottom surface projecting orthogonally downwardly therefrom, and including a plurality of radial slots directed from the central bore, wherein the central slots are spaced ninety degrees apart relative to the central bore to accommodate a sprinkler head directed through the central bore, and including plural pairs of frangible grooves radially directed from the central bore extending to a periphery of the cylindrical plate, with each pair of frangible grooves arranged in a coextensive aligned relationship, wherein one of the grooves of the pair of grooves is directed through the top surface, and a further of said grooves of the pair of grooves directed through the bottom surface.

2. A sprinkler shield as set forth in claim 1 including a torroidal tube fixedly mounted to the bottom surface concentric relative to the central bore, wherein the torroidal tube includes a liquid adhesive contained therewithin, and each spike includes a spike base plate, wherein the spike is orthogonally mounted to the base plate extending downwardly therefrom, and each spike base plate includes a plurality of base plate spikes extending orthogonally upwardly relative to the spike base plate, wherein the base plate spikes are arranged for projection into the torroidal tube in a selective relationship to effect selective securement of each of the spike base plates relative to the torroidal tube.

* * * * *